US007740187B2

(12) United States Patent
Ricco et al.

(10) Patent No.: US 7,740,187 B2
(45) **Date of Patent: *Jun. 22, 2010**

(54) INTERNAL COMBUSTION ENGINE FUEL INJECTOR

(75) Inventors: Mario Ricco, Valenzano (IT); Sisto Luigi De Matthaeis, Valenzano (IT); Adriano Gorgoglione, Valenzano (IT); Alfonso Di Meo, Valenzano (IT); Sergio Stucchi, Valenzano (IT)

(73) Assignee: C.R.F. Societa Consortile per Azioni (IT)

( * ) Notice: Subject to any disclaimer, the term of this patent is extended or adjusted under 35 U.S.C. 154(b) by 301 days.

This patent is subject to a terminal disclaimer.

(21) Appl. No.: 11/171,659

(22) Filed: Jun. 30, 2005

(65) Prior Publication Data

US 2006/0027684 A1 Feb. 9, 2006

(30) Foreign Application Priority Data

Jun. 30, 2004 (EP) ..... 04425475
May 27, 2005 (EP) ..... 05425384

(51) Int. Cl.
*F02M 41/16* (2006.01)

(52) U.S. Cl. ..... 239/96; 239/585.1; 239/585.5; 239/533.1; 239/533.3

(58) Field of Classification Search ..... 239/93, 239/95, 96, 97, 585.1, 585.5, 586, 89
See application file for complete search history.

(56) References Cited

U.S. PATENT DOCUMENTS 3,777,977 A * 12/1973 Regneault et al. ..... 239/96
4,899,935 A * 2/1990 Yoshida et al. ..... 239/91
5,088,647 A * 2/1992 Yoshida et al. ..... 239/96

(Continued)

FOREIGN PATENT DOCUMENTS

DE 38 02 648 8/1989

(Continued)

OTHER PUBLICATIONS

European Search Report dated Nov. 5, 2004 issued in corresponding European Application No. EP 04 42 5475.

(Continued)

*Primary Examiner*—Len Tran
*Assistant Examiner*—Trevor E McGraw
(74) *Attorney, Agent, or Firm*—Ostrolenk Faber LLP

(57) ABSTRACT

An internal combustion engine fuel injector (1) has a rod (10) movable along an axis (3) to open/close a nozzle, and a servovalve (7) having a control chamber (23) with a discharge passage (26, 48) which is opened/closed by a shutter (17) movable axially under the control of an electro-actuator; the servovalve also has a fixed axial rod (33) having an outer lateral surface (34) through which the discharge passage (26, 48) comes out; the shutter (17) is fitted to the axial rod (33) to slide axially in substantially fluidtight manner, and, when closing the discharge passage (26, 48), is subjected to substantially zero resultant axial pressure by the fuel; and a calibrated portion (42, 52) of the discharge passage (26, 48) is formed close to the outlet of the discharge passage to produce swirl and/or cavitation in the fuel outflow near to the closing area between the shutter (17) and the axial rod (33).

12 Claims, 3 Drawing Sheets

U.S. PATENT DOCUMENTS

| | | | | |
|---|---|---|---|---|
| 5,090,620 | A * | 2/1992 | Yoshida et al. | 239/96 |
| 5,636,615 | A * | 6/1997 | Shorey et al. | 123/506 |
| 6,168,087 | B1 * | 1/2001 | Cooke | 239/1 |
| 6,257,499 | B1 | 7/2001 | Sturman | |
| 6,283,441 | B1 * | 9/2001 | Tian | 251/30.03 |
| 6,293,254 | B1 * | 9/2001 | Crofts et al. | 123/467 |
| 6,837,221 | B2 * | 1/2005 | Crofts et al. | 123/467 |
| 6,889,918 | B2 * | 5/2005 | Harcombe | 239/533.2 |
| 6,905,083 | B2 * | 6/2005 | Ricco | 239/533.2 |
| 7,219,656 | B2 * | 5/2007 | Ricco et al. | 123/467 |
| 7,299,998 | B2 * | 11/2007 | Ricco et al. | 239/96 |
| 2003/0127532 | A1 * | 7/2003 | Coldren et al. | 239/5 |
| 2004/0000600 | A1 * | 1/2004 | Peters et al. | 239/533.2 |
| 2004/0050954 | A1 * | 3/2004 | Yamada et al. | 239/102.2 |
| 2006/0011736 | A1 * | 1/2006 | Ricco et al. | 239/96 |
| 2007/0205302 | A1 * | 9/2007 | Ricco et al. | 239/96 |

FOREIGN PATENT DOCUMENTS

| | | |
|---|---|---|
| DE | 43 10 984 | 10/1994 |
| EP | 0 262 539 | 4/1988 |
| EP | 0 740 068 | 10/1996 |
| EP | 0 823 549 | 2/1998 |
| WO | WO 01/11227 | 2/2001 |

OTHER PUBLICATIONS

European Search Report dated Aug. 26, 2005 issued in corresponding European Application No. EP 05 42 5384.

* cited by examiner

INTERNAL COMBUSTION ENGINE FUEL INJECTOR

BACKGROUND AND SUMMARY OF THE DISCLOSURE

The present invention relates to an internal combustion engine fuel injector.

As is known, an injector comprises an injector body, which defines a nozzle for injecting fuel into the engine, and houses a control rod movable along an axis to activate a pin closing the nozzle. The injector body also houses an electric control servo valve comprising a control chamber bounded axially at one side by the control rod and at the other side by an end wall having an outlet hole, which is opened/closed by a shutter to communicate with a discharge conduit and so vary the pressure in the control chamber. More specifically, the cross section of the outlet hole is calibrated to accurately set fuel flow from the control chamber to the discharge conduit, and the shutter is movable axially under the control of an electro-actuator and the axial thrust of a spring, which is preloaded to keep the outlet hole closed when the electro-actuator is idle.

A need is felt for injectors in which the shutter opening/closing the outlet hole of the control chamber is subjected to substantially zero pressure when the shutter is in the closed position, so as to reduce the preload of the spring, the force required of the electro-actuator, and therefore size, as compared with solutions in which the shutter closes the outlet hole axially. More specifically, in injectors in which the shutter is "balanced" in terms of axial pressure, even a small amount of lift of the shutter produces a large fuel flow section to the discharge conduit, thus improving dynamic performance of the injector, i.e. by eliminating so-called "bounce" of the shutter at the end of the opening and closing strokes.

At the same time, a need is also felt for an injector which, in addition to a "balanced" shutter, provides for minimizing variations in opening/closing performance of the injection nozzle with respect to design conditions.

It is an object of the present invention to provide an internal combustion engine fuel injector designed to meet the above demands in a straightforward, low-cost manner, and which, in particular, is of relatively straightforward, compact construction.

According to the present invention, there is provided a fuel injector for an internal combustion engine; the injector terminating with a nozzle for injecting fuel into a relative cylinder of the engine, and comprising:

a hollow injector body extending in an axial direction;

a control rod movable axially with respect to said injector body to open/close said nozzle;

a control servo valve housed in said injector body and comprising:

a) an electro-actuator;

b) a control chamber, which is bounded axially at one side by said control rod, communicates with a fuel inlet, and has a discharge passage comprising a calibrated portion; and c) a shutter movable axially, under the control of said electro-actuator, between a closed position, in which it closes said discharge passage, and an open position, in which it opens said discharge passage to vary the pressure in said control chamber and so produce axial movement of said control rod;

characterized in that:

said control servo valve also comprises an axial rod fixed with respect to said injector body and comprising an outer lateral surface through which said discharge passage comes out;

said shutter is fitted to said outer lateral surface to slide axially in substantially fluidtight manner, and, in said closed position, closes said discharge passage so as to be subjected to substantially zero resultant axial pressure by the fuel; and said calibrated portion is so formed as to produce swirl and/or cavitation in the fuel outflow near to the closing area between said shutter and said axial rod.

BRIEF DESCRIPTION OF THE DRAWINGS

A preferred, non-limiting embodiment of the present invention will be described by way of example with reference to the accompanying drawings, in which.

DETAILED DESCRIPTION OF PREFERRED EMBODIMENTS

Figure 1:
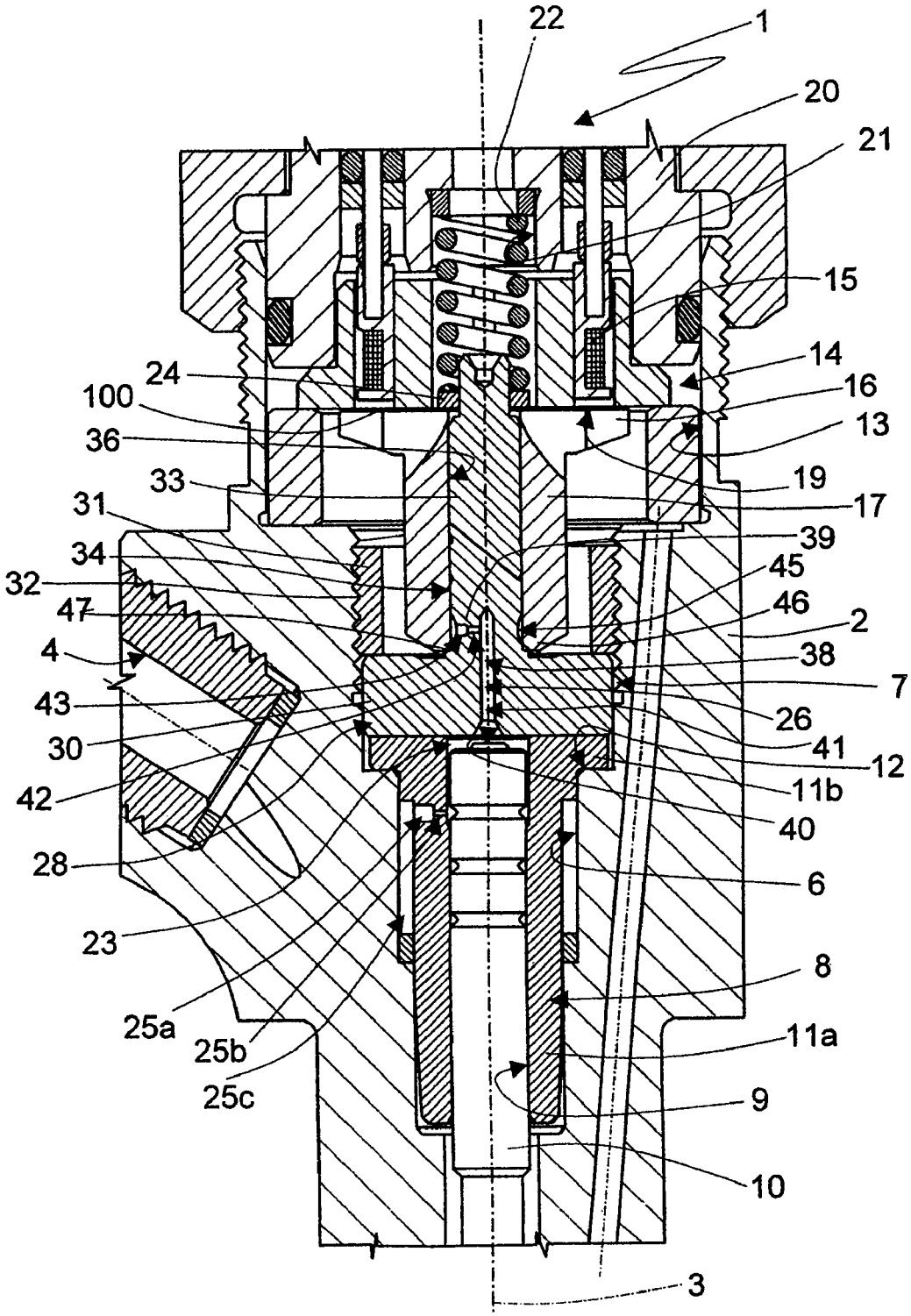
FIG. 1 shows a cross section, with parts removed for clarity, of a preferred embodiment of an internal combustion engine fuel injector in accordance with the present invention.

Number 1 in FIG. 1 indicates as a whole a fuel injector (shown partly) for an internal combustion engine, in particular a diesel engine (not shown).

Injector 1 comprises a hollow body or casing 2, normally referred to as an "injector body", extending along a longitudinal axis 3 and having a lateral inlet 4 connectable to a high-pressure, e.g. roughly 1800-bar, fuel feed conduit. Casing 2 terminates with a nozzle (not shown) communicating with inlet 4 and for injecting fuel into a relative engine cylinder.

Casing 2 defines an axial cavity 6 housing a metering servo valve 7 comprising a hollow flanged cylindrical body or so-called "valve body" 8. Body 8 has an axial hole 9, in which a control rod 10 slides axially in fluidtight manner, and comprises a tubular portion 11*a*, and an end flange 11*b* which rests on a shoulder 12 of cavity 6.

More specifically, rod 10 is movable axially to control in known manner a shutter pin (not shown) for opening and closing the injection nozzle.

Casing 2 has another cavity 13 coaxial with axis 3 and housing an actuator device 14, which comprises an electromagnet 15 for controlling a slotted-disk armature 16 terminating axially with a sleeve 17. Electromagnet 15 is defined by a magnetic core, and has a stop surface 19 perpendicular to axis 3.

Device 14 is held in position by a support 20, and has an axial cavity 21 housing a helical compression spring 22 preloaded to exert thrust on armature 16 in the opposition direction to the attraction exerted by electromagnet 15. More specifically, one end of spring 22 rests against support 20, and the other end acts on armature 16 via a washer 24.

Servo valve 7 also comprises a control or metering chamber 23 bounded radially by portion 11*a* and communicating permanently with inlet 4—to receive pressurized fuel—via a channel 25*a* formed in portion 11*a* and having a calibrated portion 25*b*, via an annular chamber 25*c* bounded radially by bodies 8 and 2, and via a passage (not shown) formed in body 2.

Here and hereinafter, "calibrated portion" is intended to mean a hole of extremely precise cross section and length to produce a given pressure difference between the inlet and outlet of the hole.

Chamber 23 is bounded axially at one side by rod 10 and at the other side by a body 28, which is formed in one piece, is interposed between chamber 23 and actuating device 14, and comprises a base portion 30 gripped axially against flange 11*b* by a threaded ring nut 31 screwed to an internal thread 32 of body 2.

Body 28 also comprises a rod 33, which is smaller in diameter than portion 30, projects from portion 30 along axis 3 towards cavity 21, and is bounded externally by a cylindrical lateral surface 34 for guiding axial slide of sleeve 17. More specifically, sleeve 17 has a cylindrical inner surface 36 fitted to lateral surface 34 in substantially fluidtight manner with an appropriate diametrical clearance, e.g. of less than 4 microns, or with the interposition of sealing members.

Chamber 23 also comprises a fuel outlet or discharge passage indicated as a whole by 26 and formed entirely inside body 28. Passage 26 comprises a first portion 38 formed along axis 3 partly in portion 30 and partly in rod 33; and a radial second portion 39 formed in rod 33 and which comes out through lateral surface 34. More specifically, portion 38 comprises a conical initial portion 40, diverging towards chamber 23, and a cylindrical dead portion 41; and portion 39 comprises a calibrated portion 42 (in the sense explained above) which comes out inside portion 41, and an outlet portion 43 larger in cross section than, and connected to, portion 42.

In a variation not shown, a larger number of portions 39 may be provided, angularly spaced about axis 3.

Portion 43 comes out of rod 33 inside an annular chamber 45 formed in lateral surface 34, axially adjacent to portion 30, and which is opened/closed by axial slide of sleeve 17. Sleeve 17 functions as a shutter, and is movable between a forward limit position, in which it closes the outlet of passage 26 and rests axially, at an end 46, on a conical shoulder 47 of body 28 between portion 30 and rod 33, and a withdrawn limit position, in which armature 16 rests axially on surface 19 with the interposition of a plate 100 defining the residual air gap between armature 16 and electromagnet 15. In the withdrawn limit position, armature 16 connects chamber 45 to a discharge conduit of the injector (not shown) via an annular passage between ring nut 31 and sleeve 17, the slots in armature 16, cavity 21, and an opening in support 20.

In other words, when electromagnet 15 is energized, armature 16, and therefore sleeve 17, (with dual function also as a shutter), is drawn towards electromagnet 15 to discharge fuel from chamber 23 and reduce the fuel pressure, and so produce axial movement of rod 10 to control the injection nozzle. Conversely, when electromagnet 15 is deenergized, spring 22 pushes armature 16, and therefore sleeve 17, (with dual function also as a shutter), into the forward limit position.

In the forward limit position, since the pressure in chamber 45 only acts radially on surface 34, the fuel exerts substantially zero resultant axial thrust on sleeve 17.

Figure 2:
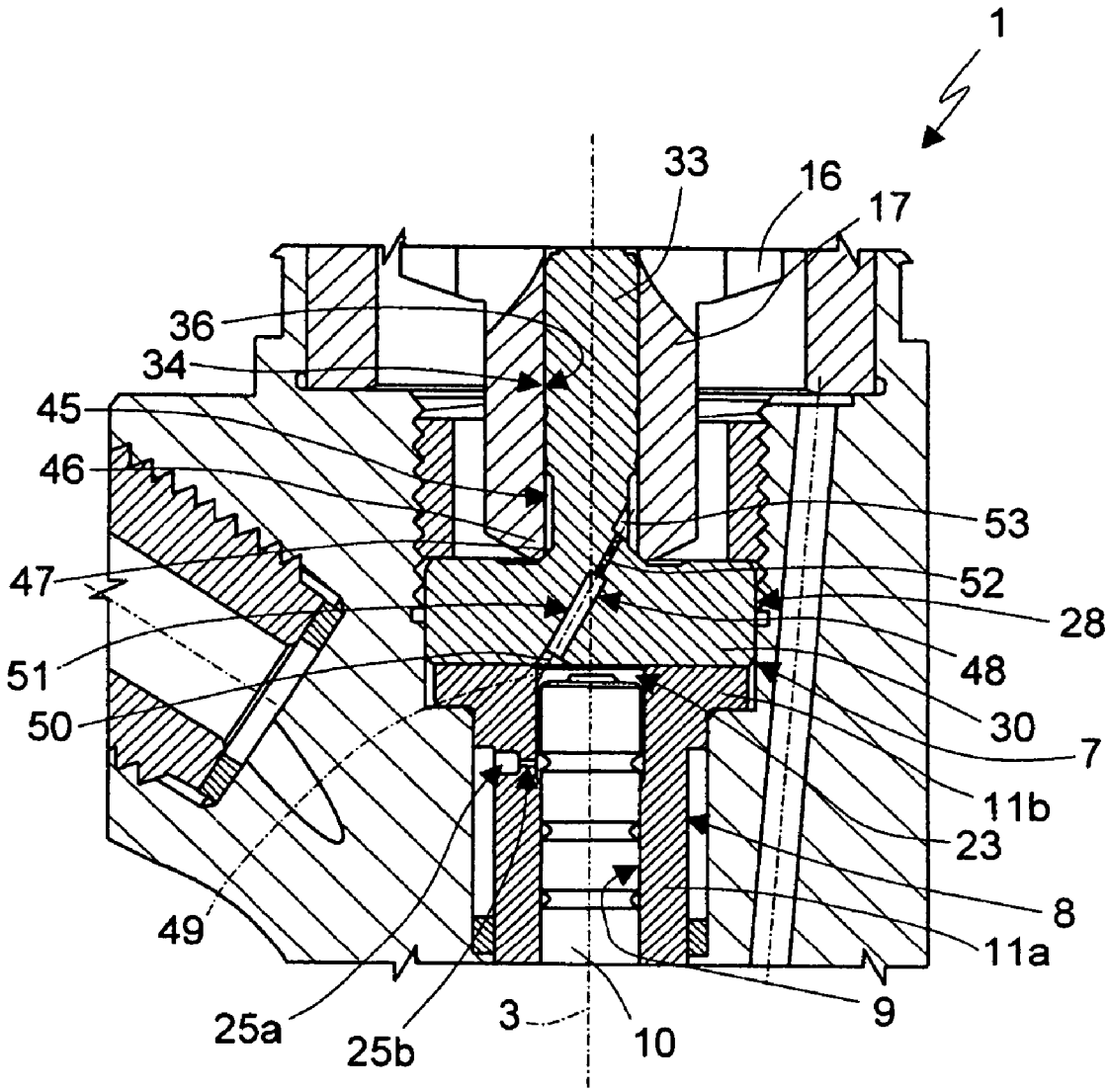
FIGS. 2 and 3 are similar to FIG. 1, and show respective variations of the FIG. 1 injector.
Figure 3:
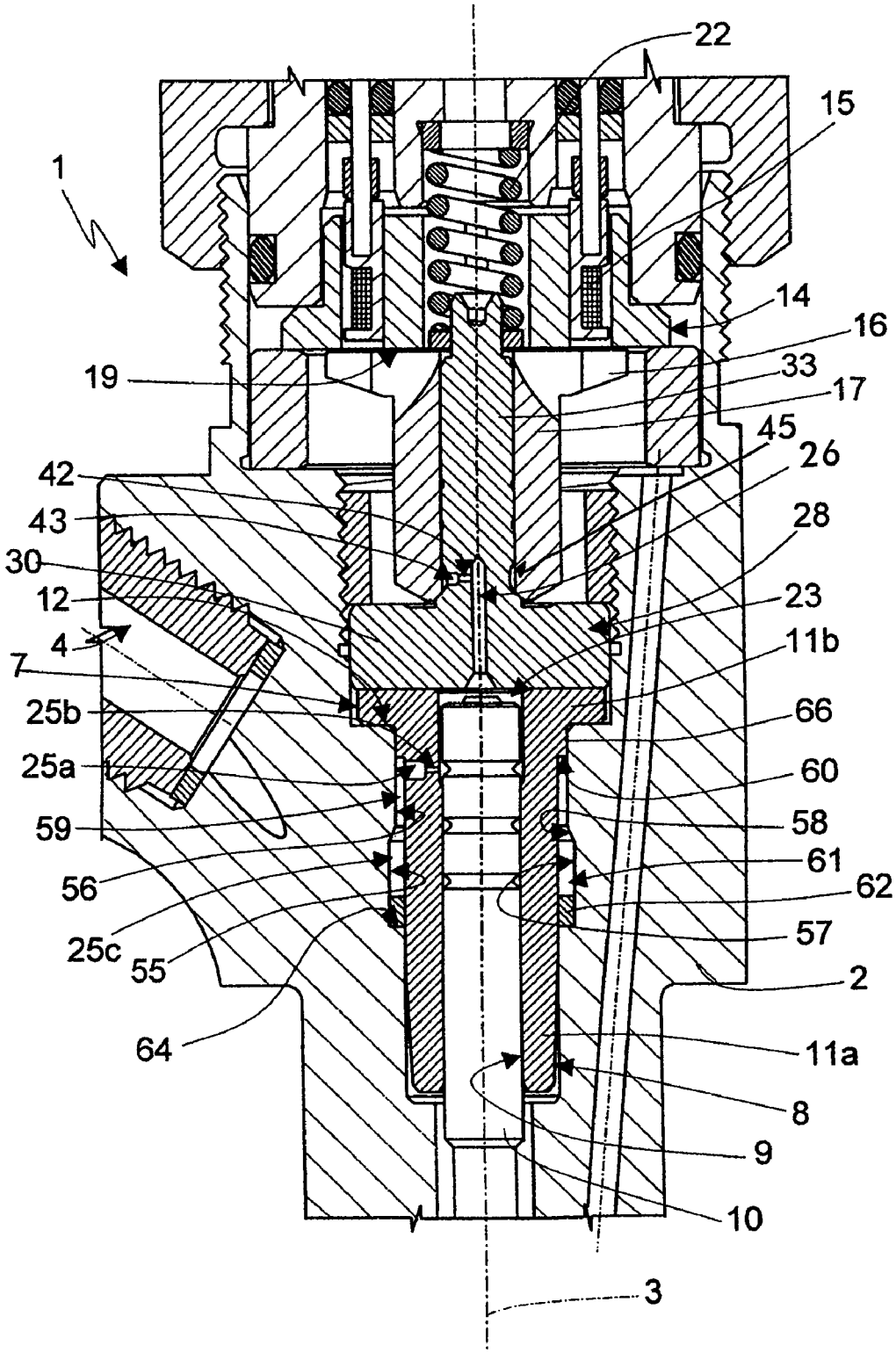

FIGS. 2 and 3 show two variations of injector 1, the component parts of which are indicated where possible using the same reference numbers as in FIG. 1. The FIG. 2 variation differs from FIG. 1 by chamber 23 having an exit or discharge passage 48 formed in body 28 and completely along a straight axis 49 sloping with respect to axis 3. More specifically, from chamber 23 to chamber 45, passage 48 comprises a conical initial portion 50 diverging towards chamber 23 and off-centred with respect to axis 3; a cylindrical portion 51; a calibrated portion 52 smaller in diameter than portion 51; and a wider end portion 53 which comes out inside chamber 45.

The FIG. 3 variation differs from FIG. 1 by the inner surface of body 2 defining chamber 25*c* not being completely cylindrical. That is, the inner surface, indicated as a whole by 55, comprises two cylindrical surfaces 56, 57 joined by a conical surface 58 converging axially towards flange 11*b*. Chamber 25*c* comprises an annular gap 59 bounded externally by surface 56 and axially by an annular shoulder 60 of body 8; and an annular gap 61 bounded externally by surface 57 and housing a sealing ring 62 interposed between bodies 8 and 2 and resting axially on an annular shoulder 64 of body 2.

More specifically, as in the FIG. 1 solution, shoulder 60 defines an annular locating projection 66.

Gap 59 is radially smaller than gap 61, so that, other geometrical and dimensional conditions being equal, the ideal fluid sealing circle between flange 11*b* and shoulder 12 is closer to axis 3 in the FIG. 3 variation than in the FIGS. 1 and 2 solutions. As a result, the area of body 8 on which the pressure of the fuel in chamber 25*c* acts axially is smaller, and the axial forces acting on body 8 towards armature 16 are therefore also reduced.

With reference to the accompanying drawings, portions 42, 52 are formed in such a position as to produce swirl and/or cavitation in the fuel outflow close to the sealing area between end 46 of sleeve 17 (with dual function also as a shutter) and shoulder 47 of body 28, i.e. immediately downstream from the outlet of passages 26, 48. More specifically, portions 42, 52 are formed close to the outlet of passages 26, 48 to minimize, downstream from portions 42, 52, relatively large fuel volumes which would otherwise produce laminar flow from passages 26, 48. Portions 43, 53 define a relatively small volume downstream from portions 42, 52, and therefore do not tend to produce laminar flow. What is more, being larger in cross section than respective portions 42, 52, they assist in producing the cavitation effect at the outlet in chamber 45.

In the presence of swirl and/or cavitation as referred to above, the discharge coefficient through portion 42, 52 and, therefore, fuel flow from passage 26, 48 are unaffected by the ambient pressure conditions in which sleeve 17 moves, so that fuel flow from chamber 23 is prevented from varying with time and/or with respect to design as a function of conditions downstream. Variations in flow, in fact, are highly undesirable by producing variations in fuel discharge time from chamber 23 and, therefore, in the opening/closing time of the nozzle of injector 1 with respect to design conditions.

Variations in fuel discharge time and, therefore, in nozzle opening/closing time with respect to design conditions are also reduced by reducing static drift in the axial position of the components housed in body 2. That is, the high in-service pressures in chamber 25*c* normally tend to produce static drift in the axial position of portion 30 towards armature 16, thus reducing the maximum travel of armature 16 and sleeve 17, and so resulting in a variation in fuel flow from chamber 45 to the discharge conduit with respect to design, on account of the different opening and closing times of armature 16 and sleeve 17.

In the FIG. 3 variation, static drift is reduced by reducing the radial size of gap 59 with respect to chamber 25*c* in FIG. 1, and so reducing axial pressure on body 8 towards armature 16, as explained in detail above. Static drift is also reduced by the high degree of rigidity of the components as a whole inside body 2, due to the absence of additional bodies or spacers between chamber 23 and body 28.

The absence of additional bodies between chamber 23 and body 28 also reduces the axial size of servo valve 7, and greatly simplifies production of injector 1 by eliminating complex finish machining and/or surface hardening, which would otherwise be necessary to achieve the precision fits and machining tolerances necessary to ensure high-pressure metal-metal sealing.

Clearly, changes may be made to injector 1 as described and illustrated herein without, however, departing from the scope of the present invention as defined in the accompanying Claims.

In particular, body 28 need not have a base portion 30 wider than rod 33, and/or may comprise an adjusting spacer between flange 11*b* and body 28, though, in this case, additional finish machining and surface hardening would be required.

The invention claimed is:

1. A fuel injector for an internal combustion engine; the injector having a nozzle for injecting fuel into a relative cylinder of the engine, and comprising:

a hollow injector body extending in an axial direction;

a control rod movable axially with respect to said injector body to open and close said nozzle;

a control servo valve housed in said injector body and comprising:

a) an electro-actuator;

b) a control chamber, which is bounded axially at one side by said control rod, communicates with a fuel inlet, and has a discharge passage comprising a calibrated portion; and c) a sleeve movable axially, under the control of said electro-actuator, between a closed position, in which it closes said discharge passage, and an open position, in which it opens said discharge passage to vary the pressure in said control chamber and so produce axial movement of said control rod;

wherein said control servo valve also comprises an axial rod fixed with respect to said injector body and an outer lateral surface on the axial rod through which said discharge passage comes out;

said sleeve being fitted to said outer lateral surface to slide axially in substantially fluidtight manner, and, in said closed position, being effective to close said discharge passage so as to be subjected to substantially zero resultant axial pressure by the fuel; and wherein said calibrated portion is formed in the axial rod close to the outlet of said discharge passage to produce swirl or cavitation in the fuel outflow near to the closing area between said sleeve and said axial rod.

2. An injector as claimed in claim 1, characterized in that said calibrated portion extends radially.

3. An injector as claimed in claim 1, characterized in that said discharge passage terminates with a portion having a cross section larger than that of said calibrated portion.

4. An injector as claimed in claim 1, wherein said closing area is formed between an end of said shutter and a shoulder integral with said rod.

5. An injector as claimed in claim 4, wherein said rod is integral with said a body bounding axially said control chamber, said shoulder being formed between said rod and a portion of said body having a diameter larger than the one of said rod.

6. A fuel injector for an internal combustion engine; the injector having a nozzle for injecting fuel into a relative cylinder of the engine, and comprising:

a hollow injector body extending in an axial direction;

a control rod movable axially with respect to said injector body to open and close said nozzle;

a control servo valve housed in said injector body and comprising:

a) an electro-actuator;

b) a control chamber, which is bounded axially at one side by said control rod, communicates with a fuel inlet, and has a discharge passage comprising a calibrated portion; and c) a sleeve movable axially, under the control of said electro-actuator, between a closed position, in which it closes said discharge passage, and an open position, in which it opens said discharge passage to vary the pressure in said control chamber and so produce axial movement of said control rod;

wherein said control servo valve also comprises an axial rod fixed with respect to said injector body and an outer lateral surface through which said discharge passage comes out;

said sleeve being fitted to said outer lateral surface to slide axially in substantially fluidtight manner, and, in said closed position, being effective to close said discharge passage so as to be subjected to substantially zero resultant axial pressure by the fuel; and wherein said calibrated portion is formed close to the outlet of said discharge passage to produce swirl or cavitation in the fuel outflow near to the closing area between said sleeve and said axial rod, characterized in that said control chamber is bounded radially by a tubular portion in turn defining outwards an annular chamber connecting said control chamber to said inlet; said annular chamber comprising a first annular gap housing a sealing ring interposed between said tubular portion and said injector body, and a second annular gap bounded axially by a shoulder of said tubular portion and smaller radially than said first annular gap.

7. An injector as claimed in claim 6, wherein said first and said second annular gap are defined, on said injector body, by respective cylindrical surfaces connected to each other by a conical surface converging from the first to the second annular gap.

8. A fuel injector for an internal combustion engine; the injector having a nozzle for injecting fuel into a relative cylinder of the engine, and comprising:

a hollow injector body extending in an axial direction;

a control rod movable axially with respect to said injector body to open and close said nozzle;

a control servo valve housed in said injector body and comprising:

a) an electro-actuator;

b) a control chamber, which is bounded axially at one side by said control rod, communicates with a fuel inlet, and has a discharge passage comprising a calibrated portion; and c) a sleeve movable axially, under the control of said electro-actuator, between a closed position, in which it closes said discharge passage, and an open position, in which it opens said discharge passage to vary the pressure in said control chamber and so produce axial movement of said control rod;

wherein said control servo valve also comprises an axial rod fixed with respect to said injector body and an outer lateral surface through which said discharge passage comes out;

said sleeve being fitted to said outer lateral surface to slide axially in substantially fluidtight manner, and, in said closed position, being effective to close said discharge passage so as to be subjected to substantially zero resultant axial pressure by the fuel; and wherein said calibrated portion is formed close to the outlet of said discharge passage to produce swirl or cavitation in the fuel outflow near to the closing area between said sleeve and said axial rod, wherein said closing area is formed between an end of said sleeve and a shoulder integral with said rod, said rod is integral with said a body bounding axially said control chamber, said shoulder being formed between said rod and a portion of said body having a diameter larger than the one of said rod, wherein said rod is provided with a cylindrical lateral surface slidably engaging a cylindrical inner surface of said shutter substantially in a fluid tight manner, and wherein an annular chamber is formed between said lateral surface and said inner surface and is located between said discharge passage and said closing area.

9. An injector as claimed in claim 8, characterized in that said discharge passage is formed in a straight direction.

10. An injector as claimed in claim 8, wherein said discharge passage comprises a first portion formed partially in the portion of said body and partially in said rod, and a second portion coming out through said annular chamber, said first portion of said discharge passage starting from said control chamber with a conical portion diverging toward said control chamber.

11. An injector as claimed in claim 10, wherein said second portion includes said calibrated portion and a portion of a relatively large volume downstream from said calibrated portion.

12. A fuel injector for an internal combustion engine; the injector having a nozzle for injecting fuel into a relative cylinder of the engine, and comprising:

a hollow injector body extending in an axial direction;

a control rod movable axially with respect to said injector body to open and close said nozzle;

a control servo valve housed in said injector body and comprising:

a) an electro-actuator;

b) a control chamber, which is bounded axially at one side by said control rod, communicates with a fuel inlet, and has a discharge passage comprising a calibrated portion; and c) a sleeve movable axially, under the control of said electro-actuator, between a closed position, in which it closes said discharge passage, and an open position, in which it opens said discharge passage to vary the pressure in said control chamber and so produce axial movement of said control rod;

wherein said control servo valve also comprises an axial rod fixed with respect to said injector body and an outer lateral surface on the axial rod through which said discharge passage comes out;

said sleeve being fitted to said outer lateral surface to slide axially in substantially fluidtight manner, and, in said closed position, being effective to close said discharge passage so as to be subjected to substantially zero resultant axial pressure by the fuel; and wherein said calibrated portion is formed in the axial rod close to the outlet of said discharge passage to produce swirl or cavitation in the fuel outflow near to the closing area between said sleeve and said axial rod, said discharge passage is formed entirely in a single fixed body comprising said axial rod and axially defining said control chamber at the opposite side to said control rod, said control chamber is bounded radially by a tubular portion forming part of a valve body distinct from said fixed body; said fixed body comprising a base portion larger in diameter than said axial rod, axially defining said control chamber, and gripped axially against said valve body.

* * * * *